United States Patent [19]

Dyer

[11] 4,232,474

[45] Nov. 11, 1980

[54] TOY SAFE WITH ALARM

[75] Inventor: Robert F. Dyer, Rancho Palos Verdes, Calif.

[73] Assignee: Mattel, Inc., Hawthorne, Calif.

[21] Appl. No.: 12,921

[22] Filed: Feb. 16, 1979

[51] Int. Cl.[3] ..... A63H 33/00

[52] U.S. Cl. ..... 46/2; 46/14; 109/43; 116/91

[58] Field of Search ..... 46/2, 14; 116/85, 86, 116/91; 109/38, 39, 43, 41

[56] References Cited

U.S. PATENT DOCUMENTS

| | | | |
|---|---|---|---|
| 100,933 | 3/1870 | Shaler | 116/85 |
| 256,145 | 4/1882 | Knight | 116/91 |
| 515,260 | 2/1894 | Smith | 116/85 |
| 2,255,603 | 9/1941 | Vinz | 116/85 |
| 2,443,553 | 6/1948 | Cadenhead | 116/91 |
| 2,649,751 | 8/1953 | Obrock | 116/91 |
| 4,034,697 | 7/1977 | Russell | 116/86 |

FOREIGN PATENT DOCUMENTS

| | | | |
|---|---|---|---|
| 411162 | 4/1910 | France | 116/91 |
| 1501055 | 10/1967 | France | 109/38 |

OTHER PUBLICATIONS

Logan–Item from *Playthings*, of Apr., 1959, p. 148, showing "Secret Picture Bank".

*Primary Examiner*—F. Barry Shay
*Attorney, Agent, or Firm*—John G. Mesaros; Ronald M. Goldman; Max E. Shirk

[57] ABSTRACT

A toy safe having a box-like housing forming a compartment and a closure member hingedly coupled thereto for closing the compartment. An alarm mechanism is provided adjacent a sidewall of the housing with an aperture extending through the sidewall in proximity thereto. The alarm mechanism includes an alarm member such as a bell with a clapper mechanism pivotally mounted within the compartment adjacent the bell, the clapper mechanism having a tab portion in proximity to the aperture for engagement by a key member inserted through the aperture. The spring-wound actuating member coacts with the clapper member to intermittently pivot the same during unwinding of the spring, the actuating member including a handle positioned and configured relative to the interior of the closure member with a stop member engaging the handle member to prevent unwinding of the spring after the key is removed and to permit actuation of the alarm mechanism when the closure member is opened without the key.

4 Claims, 6 Drawing Figures

TOY SAFE WITH ALARM

BACKGROUND OF THE INVENTION

The background of the invention will be discussed in two parts:

1. Field of the Invention

This invention relates to toys, and more particularly to a toy safe or vault having a mechanical alarm mechanism operable in response to opening of the door without the use of the "key" provided with the toy.

2. Description of the Prior Art

With the advent of posable figure toys commonly referred to as fashion dolls, children find great amusement in providing such dolls with a real life play environment. Doll houses and furniture and the like are available in scaled sizes to the figure toys.

Similarly, many different outfits and accessories are likewise available for such dolls including such items as fur coats and jewels.

It is an object of the present invention to provide a fashion doll accessory for storing articles such as doll clothing and the like.

It is another object of the present invention to provide a new and improved toy safe having an alarm mechanism operable upon entry without a key.

It is still another object of the present invention to provide a new and improved toy safe with an alarm mechanism and having a picture frame as a component thereof.

SUMMARY OF THE INVENTION

The foregoing and other objects of the invention are accomplished by providing a box-like housing forming a compartment with an opening, and a closure member such as a door hingedly coupled to one edge of the housing for closing the opening. The opposite edge has hingedly coupled thereto a simulated picture frame.

Positioned within the compartment adjacent one sidewall of the housing is an alarm mechanism which includes an alarm member such as a bell and a clapper pivotally coupled adjacent thereto. A spring-wound actuating member is provided for coacting with the clapper member for pivoting the same for impacting with the bell in response to unwinding of the spring. the clapper member includes a tab portion in spaced proximate relation to a sidewall of the housing with an aperture extending through the sidewall for insertion therein of a simulated key member which restrains the clapper member with the key therein. A handle is provided for winding the actuating member, the handle including a portion extending toward the opening for engagement by a stop member on the door which restrains the actuating member from rotation so long as the door is closed. To open the door without sounding the alarm the key member must be inserted into the aperture, with corresponding opening of the door without the key member resulting in the sounding of the alarm mechanism.

Other objects, features and advantages of the invention will become apparent from a reading of the specification when taken in conjunction with the drawings in which like reference numerals refer to like elements in the several views.

DESCRIPTION OF THE PREFERRRED EMBODIMENT

Figure 1:
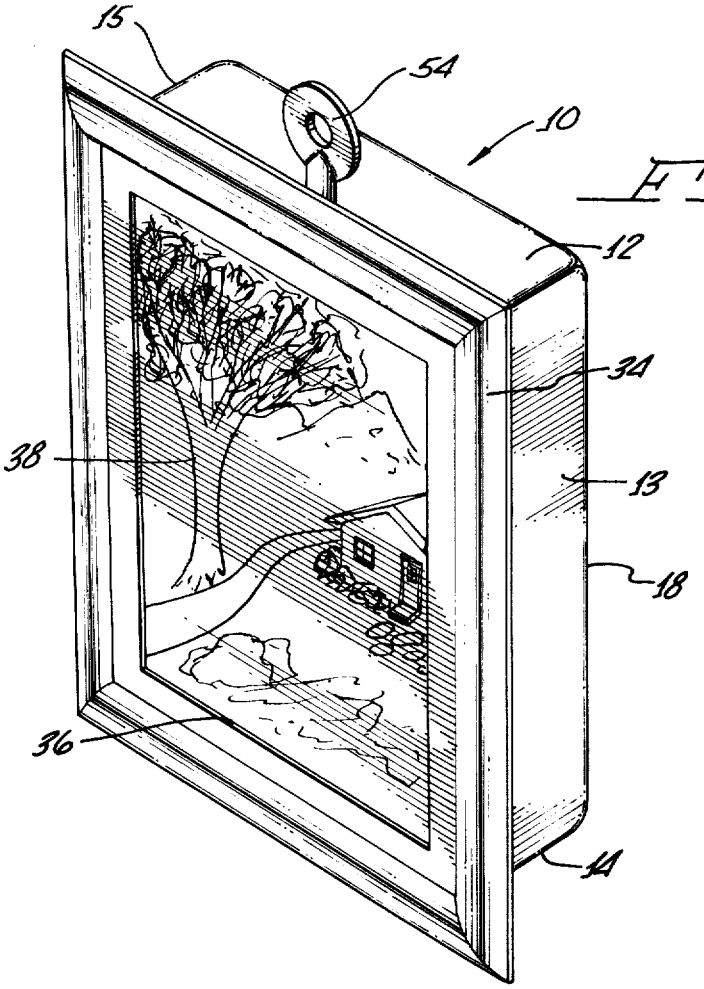
FIG. 1 is a perspective view of a toy safe according to the invention.
Figure 2:
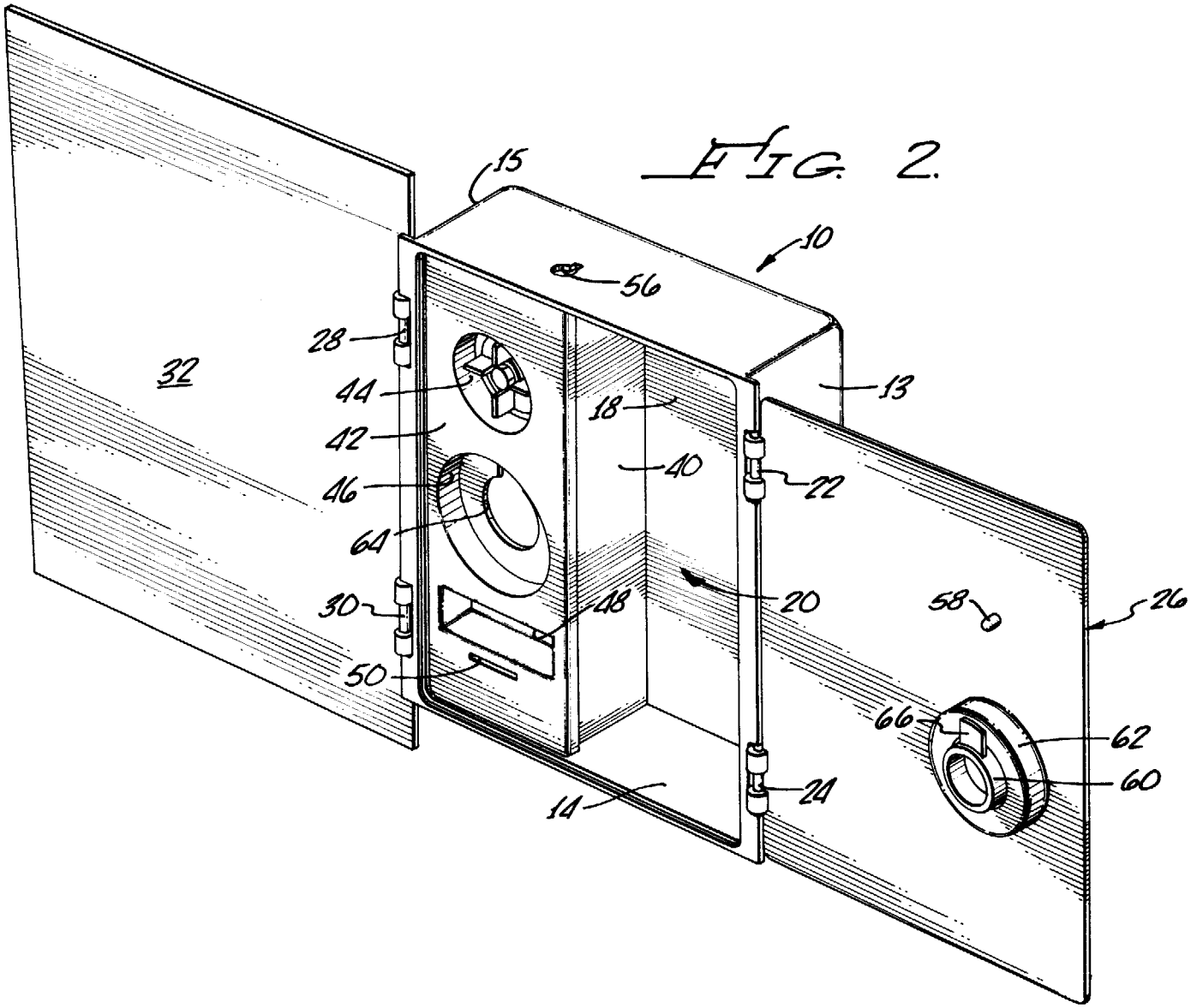
FIG. 2 is a perspective view of the toy safe of FIG. 1 with the closures thereof opened to reveal the interior compartment.

Referring now to the drawings and particularly to FIGS. 1 and 2 there is illustrated a toy safe according to the invention which includes a generally box-like housing, generally designated 10 having four sidewalls 12–15 and a back wall 18 defining a compartment generally designated 20 with an open front. Hingedly coupled to one long edge of sidewall 13 by means of suitable hinge couplings 22 and 24 is a first closure member 26 which is a generally plate-like door member configured for substantially closing the opening of the compartment 20. Hingedly coupled along the edge of the opposite sidewall 15 by suitable hinges 28 and 30 is a second closure member 32 which, as illustrated in FIG. 1, when closed has a picture frame 34 on the exposed surface thereof with a picture opening 36 configured for receiving a suitable picture 38. As shown in FIG. 1, the conventional outward appearance of the toy safe as viewed from the front will be that of the normal picture frame.

As best depicted in FIG. 2, the interior of the compartment 20 is subdivided by a partition 40 into a first long subcompartment intermediate the partition 40 and the sidewall 13 with the area between partition 40 and sidewall 15 having a cover plate 42 thereon. The cover plate 42 is provided with a first generally circular recessed portion 44 and a second generally circular recessed portion 46 with the lower portion being suitably slotted such as at 48 and 50. The cover plate 42 may be suitably secured to the partition or divider 40 and the opposite sidewall 15. The subcompartments thus formed may be used for different things. For example, the elongate subcompartment may be used for doll clothes such as fur coats and the like while the slots 48 and 50 provide access to the subcompartment on the opposite side of partition 40 and may be used as a savings bank. The upper left hand corner as viewed in FIG. 2 has extending through the recess 44 a rotatable handle generally designated 52 which, as will hereinafter be described, is used for winding the main spring of an alarm mechanism which can be deactivated by means of insertion of a key member 54 (see FIGS. 1, 3 and 4) inserted through a keyhole shaped aperture 56 in sidewall 12 adjacent the alarm mechanism. The alarm mechanism is activated by rotation of the handle 52 with the key member 54 then being inserted through the aperture 56 for deactivating the same, and the closure member 26 is then rotated to the closed position and a stub-shaft projection or stop 58 formed on the interior surface of the door 26 engages one of the paddles or ears of the handle 52 for restraining the handle 52 from unwinding rotation. The key 54 is then removed and the alarm is thus set. For securing the door 26 in the closed position, a rotatable locking member 60 is mounted within a generally circular recess 62 formed on the door 26, the rotatable locking member 60 being in general alignment with the recess 46 of cover plate 42, the recess 46 having a keyhole shaped aperture 64 through which extends the lock tab 66 of locking member 60, and with a simple rotation, the door 26 is thus secured.

Referring now to FIGS. 3–6 the details of the alarm mechanism will be discussed. As shown in exploded perspective view in FIG. 3, the alarm mechanism includes a clapper member generally designated 70, a torsion spring 72, and actuating member generally designated 74, an alarm member such as a bell 76, and handle member 52.

Figure 6:
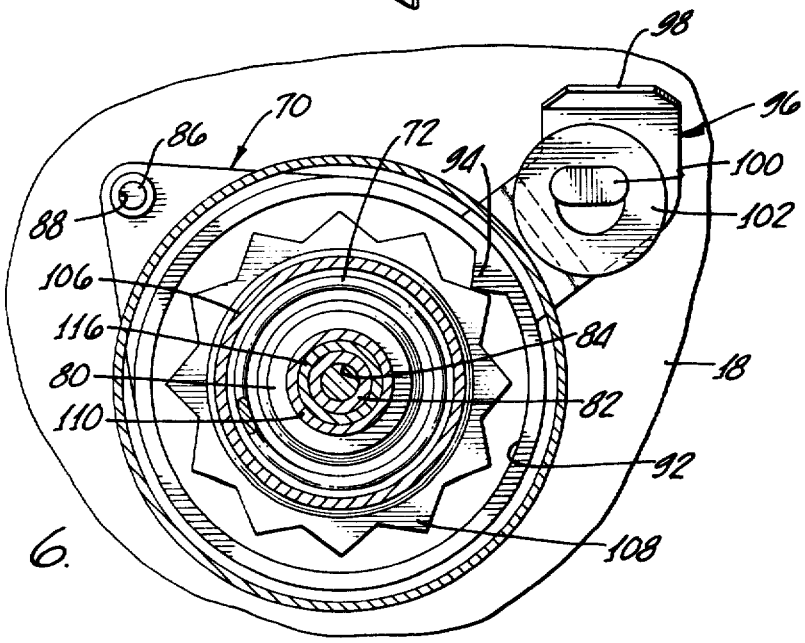
FIG. 6 is a cross-sectional view of the alarm mechanism as viewed generally along line 6—6 of FIG. 5.

The rear wall 18 has formed integrally therewith, or secured thereto a pivot boss having a first enlarged diameter portion 80 and a smaller diameter projection 82 with a threaded aperture 84 in the end thereof, the boss being generally perpendicular to the plane of the rear wall 18 and extending into the subcompartment formed between sidewall 15 and partition 40 in proximity to the upper left hand corner adjacent the keyhole shaped aperture 56. A pivot projection 86 is likewise formed adjacent the upper left hand corner for receiving the pivot aperture 88 of the clapper member 70. Referring also to FIG. 6, the clapper member 70 has a generally circular main body portion with a centrally disposed aperture 90 having a diameter slightly larger than the diameter of the boss portion 80 which is encircled thereby. A generally circular recess 92 is formed in the main body portion of the clapper member 70 with the diameter thereof larger than the diameter of the aperture 90 with the recess including a radially inwardly extending tooth member 94 which, as will hereinafter be described, coacts with the actuating member 74. Although only one tooth member 94 is illustrated, it is to be understood that a plurality of such teeth member may likewise be provided in accordance with the invention. Extending outwardly amd integral with the main body portion of the clapper member 70 is an arm portion 96 extending generally in the main plane of the clapper member 70 with the arm 96 terminating with a generally perpendicularly disposed tab portion 98. The arm 96 is also provided with an integrally formed mushroom-shaped boss 100 configured for receiving thereon in loosely mounted relation a steel washer member 102, the washer member 102 actually impacting with the metal dome-shaped bell 76.

Figure 3:
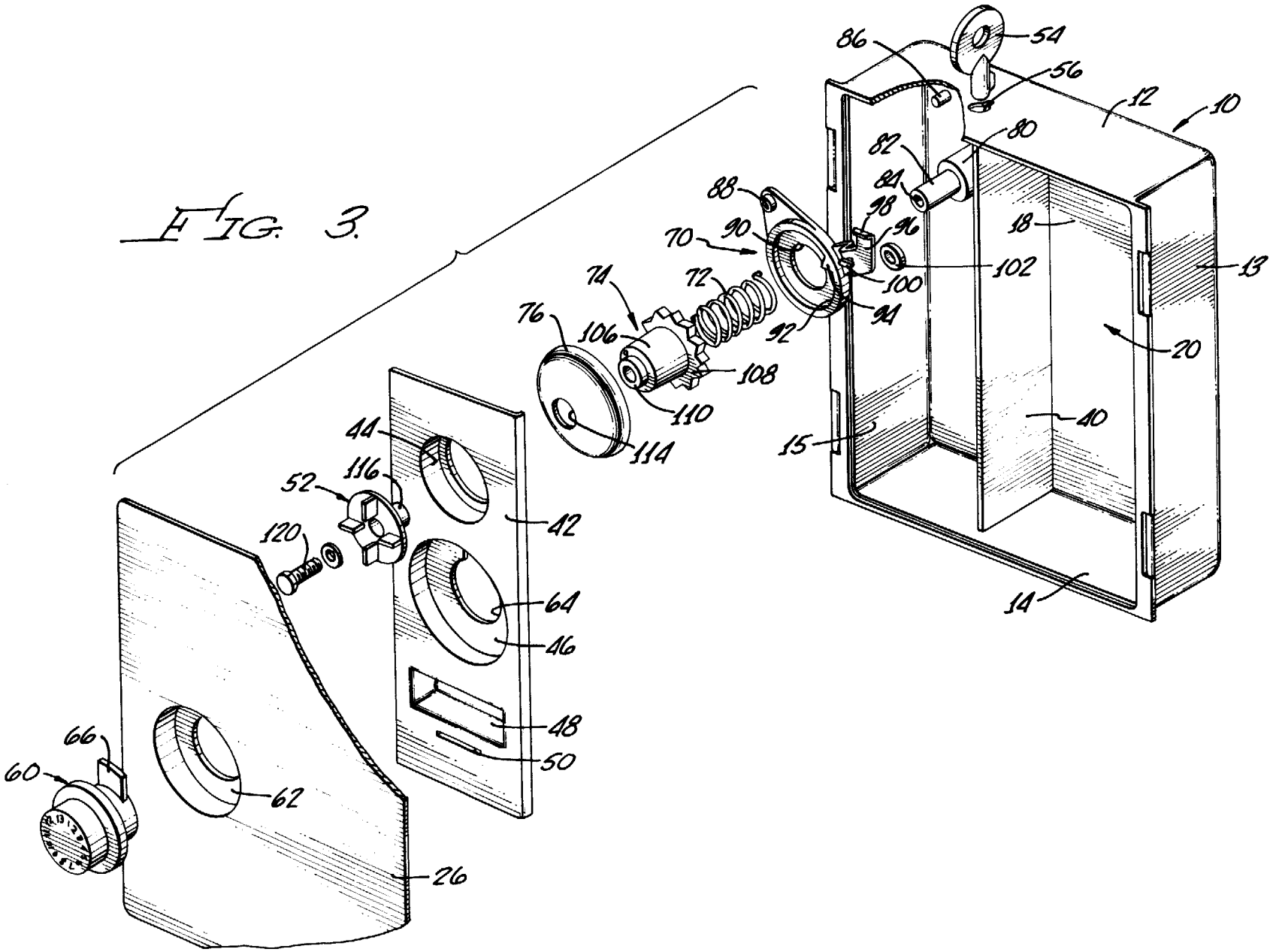
FIG. 3 is an exploded perspective view of the safe of FIG. 1, partially broken away with one closure member omitted for clarity.
Figure 5:
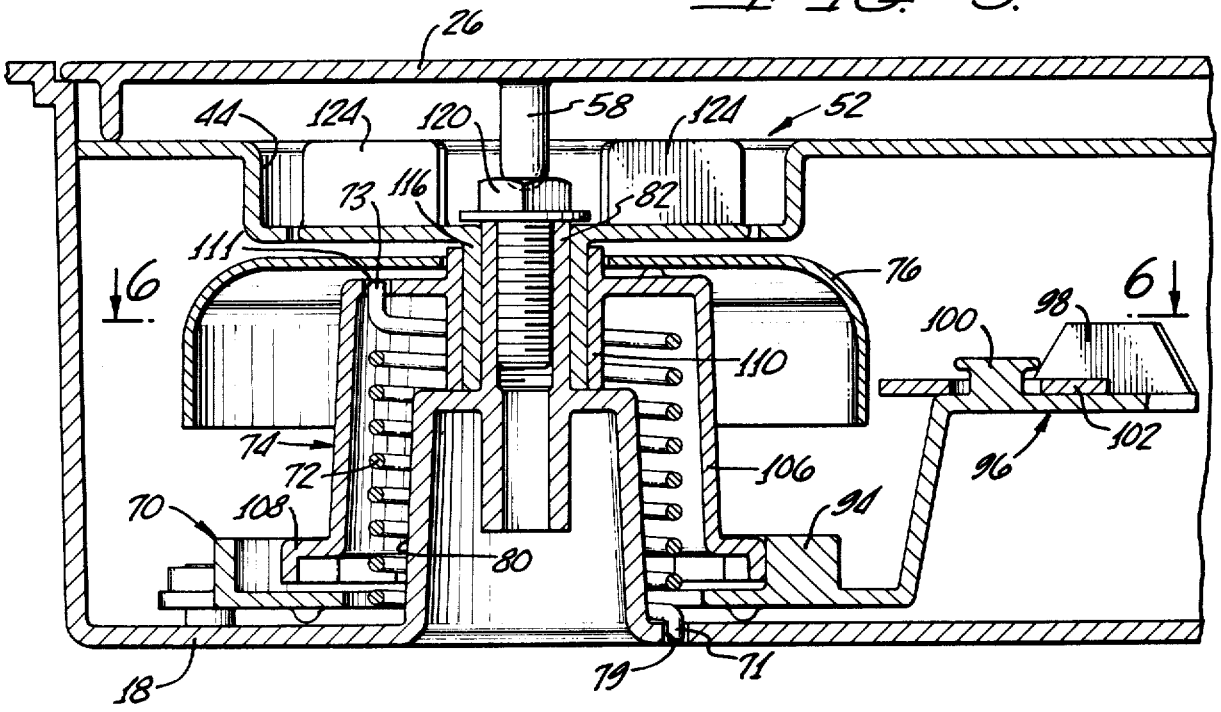
FIG. 5 is a cross-sectional view of the alarm mechanism as viewed generally along broken line 5—5 of FIG. 4.

The actuating member 74, referring to FIGS. 3 and 5, is provided with a cylindrically tapered shell portion 106 and an enlarged diameter toothed flange 108, the dimensioning of the flange 108 being best illustrated in FIG. 6 and having an outer diameter smaller than the inner diameter of the recess 92 with each of the teeth of the flange 108 being configured to sequentially engage the tooth 94 of the clapper member 70. The opposite end of the actuating member 74 is provided with a cylindrical sleeve 110 of smaller diameter than the shell portion 106 with an opening extending therethrough, the outer diameter of sleeve 110 being slightly smaller than the diameter of a centrally disposed aperture 114 formed in bell member 76, and the inner diameter of sleeve 110 being sufficient for passage therethrough of the pivot shaft portion 116 of the handle member 52.

Figure 4:
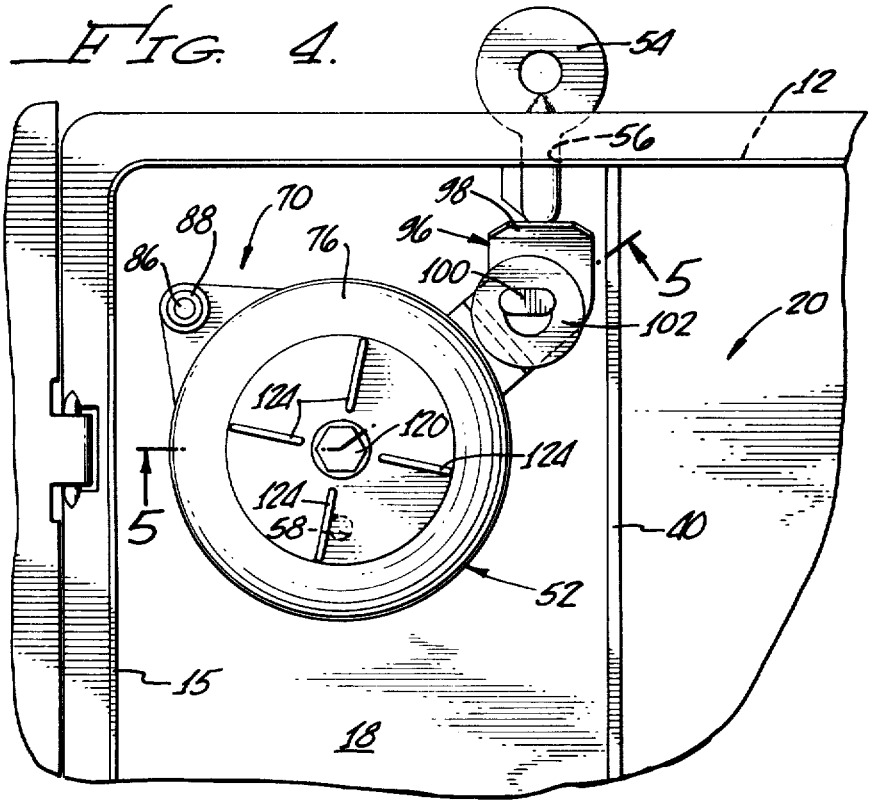
FIG. 4 is a front view of one corner of the housing illustrating the alarm mechanism according to the invention.

Referring now to FIGS. 4–6, the alarm mechanism is illustrated in assembled relation within the subcompartment of the housing 10. The clapper member 70 is pivotally supported on the pivot projection 86 with the pivot boss 88 thereof engaging the pivot projection 86. The central aperture 90 of the clapper member 70 is positioned over the enlarged boss portion 80 within the housing 10, and as thus assembled, with reference to FIG. 6 particularly, the clapper member 70 has a natural tendency to pivot clockwise under the force of gravity.

Referring particularly to FIG. 5, in assembled relation, the clapper member 70 is positioned as described above, and the torsion spring 72 encircles the boss portion 80 with one end 71 of the spring 72 extending through an aperture 79 in the rear wall 18 of the housing 10. The actuating member 74 is then positioned over the spring 72 with the other end 73 of spring 72 extending through an aperture 111 formed in the shelf portion of the shell 106 of actuator member 74. Thus, rotation of the actuating member 74 will store energy in the spring 72 as will be described hereinafter. Upon assembly of actuating member 74 the sleeve portion 110 thereof loosely fits about the reduced diameter boss portion 82 formed within the subcompartment. The bell 76 is then positioned on the assembly with the sleeve 110 extending through the aperture 114 of bell 76 in a slightly loose fitting manner. The assembly is then completed by mounting the handle 52 with the sleeve 116 thereof extending through the opening of sleeve 110 and a suitable fastening means such as a bolt 120 threadably engages the threaded opening 84 of the boss portion 82. The sleeve 116 of the handle 52 is suitably keyed to the interior of the sleeve 110 of the actuating member 74 to thereby permit rotation manually of the actuating member 74 by rotation of the handle 52.

The handle 52 is provided with a plurality of radially extending veins or paddles 124 adapted for gripping by the child to enable the rotation. The flange portion 126 of the handle member 52 is coextensive with the aperture formed in the recess 44 of the cover plate 42 with the upper edges of the paddles 124 defining a plane generally coextensive with the plane of cover plate 42. As illustrated in FIG. 5, with the closure member 26 in its closed position, the stop member 58 formed on the interior surface thereof is so configured and so dimensioned to fit into the spaces between adjacent ones of the paddles 124 to thereby restrain rotation of handle member 52 with the closure member 26 closed thereby preventing the alarm mechanism from sounding.

Referring now to FIGS. 4–6 and particularly to FIG. 4, the alarm mechanism is shown as being adjacent the upper left hand corner of the compartment 20 with the clapper member 70 having the tab portion 98 thereof in general alignment with and in proximate relation to the aperture 56 formed in sidewall 12 of the housing 10. The handle member 52 and bell member 76 are generally coaxially aligned with the outer periphery of the bell 76 being in proximate spaced relation to the steel washer 102 mounted on the projection 100 of the arm 96 of the clapper member 70. Illustrated in dotted lines is the position of the stop 58 of the closure member 26. Winding of the spring is by rotation of the handle 52 in a clockwise direction, with unwinding being in the counterclockwise direction, and as illustrated in FIG. 4, the handle 52 is precluded from unwinding due to the paddle 124 urging against the stop 58 of the closure member 26. With the key 54 extending through the aperture 56 for engagement of the lower end thereof with the tab 98 of clapper member 70, the closure 26 may be opened without sounding the alarm.

By reference to FIG. 6, if the closure is opened without the use of the key 54, the tab 98 of clapper member 70 is free to move, and during the unwinding of the spring 72, each tooth of the toothed flange 108 of the actuating member 74 will urge against the single tooth 94 formed in the recess 92 of the main body portion of the clapper member 70, thereby pivoting clapper member 70 couterclockwise in response to the urging upwardly by reason of the coaction of the teeth. During each intervening valley of the teeth of the toothed flange 108, the clapper member 70, under the force of gravity, will pivot clockwise at which time the steel washer 102 will drop and impact with the outer periphery of the bell 76, thus sounding the alarm for the duration of the unwinding of the spring 72.

For use by the child, the child can place the valuables of the fashion doll within the compartment 20. The child then rotates the handle 52 in a clockwise direction to store energy in the spring 72, and then inserts the key 54 through the aperture 56 to urge against the tab 98 of the clapper 70 to secure the alarm from sounding until closure member 26 is closed and secured by rotation of the rotatable locking member 60 when properly positioned within the aperture 64 of cover plate 42. With the primary closure member 26 thus secured, the key 54 may then be removed and the natural unwinding tendency of spring 72 rotates actuating member 74 counterclockwise until a paddle 124 of the handle 52 urges against the stop 58 as illustrated in FIG. 4. The oppositely disposed closure member 32 is then pivoted into abutting relation with the door 26, thus exposing the picture 38 within the frame 36 as illustrated in FIG. 1, giving the appearance of a conventional picture frame, rather than revealing the safe.

While there has been shown and described a preferred embodiment it is to be understood that various other adaptations and modifications may be made within the spirit and scope of the invention.

What is claimed is:

1. In a toy safe, the combination comprising:

a generally box-like housing forming a compartment with a rear wall and a plurality of sidewalls;

an aperture extending through one of said sidewalls;

a clapper member pivotally mounted within said compartment adjacent said aperture, said clapper member having a portion in aligned spaced proximate relation with said aperture, said clapper member having an enlarged main body portion with an opening extending therethrough;

a boss formed on the rear wall of said housing extending through the opening of said main body portion;

a spring member encircling said boss portion and having one end thereof fixed relative to said housing;

an actuating member rotatably mounted on said boss portion and having means for fixing the other end of said spring member thereto, rotation of said actuating member in a first direction storing energy in said spring member;

coacting means on said actuating member and said main body portion for intermittently pivoting said clapper member in response to rotation of said actuating member in and opposite direction under force of said spring member;

a bell member mounted on said boss portion in proximate relation to said clapper member;

means on said clapper member for contacting said bell member in response to said intermittent pivoting;

a handle member coupled to said actuating member for concurrent rotation therewith;

a closure member hingedly coupled to said housing for closing the opening of said compartment, said closure member having means coacting with said handle member for restraining rotation thereof with said closure member closed; and another member insertable through said aperture in said sidewall for coacting with a portion of said clapper member for restraining said clapper member from pivoting with said closure member open.

2. The combination according to claim 1 wherein said handle member includes a plurality of radially extending paddles and said means coacting with said handle member includes a stop projection configured and dimensioned for positioning in the space between adjacent paddles.

3. The combination according to claim 2 wherein said coacting means on said actuating member includes at least one inwardly extending tooth member within a recess in the main body portion of said clapper member and a toothed flange on said actuating member for coacting therewith.

4. The combination according to claim 3 wherein said safe further includes a second closure member hingedly coupled to an opposite sidewall of said housing for overlying said first closure member.

* * * * *